United States Patent [19]

Weber

[11] Patent Number: 4,591,314

[45] Date of Patent: May 27, 1986

[54] HYDRAULIC POWER SUPPLY SYSTEM UTILIZING A SOLID PROPELLANT GAS GENERATOR

[75] Inventor: Kent Weber, Rockford, Ill.

[73] Assignee: Sundstrand Corporation, Rockford, Ill.

[21] Appl. No.: 629,162

[22] Filed: Jul. 9, 1984

[51] Int. Cl.[4] ..... F04B 49/00; F04B 17/00; F02C 9/00; F02C 3/26

[52] U.S. Cl. ..... 417/47; 417/381; 60/39.25; 60/39.47; 137/522

[58] Field of Search ..... 417/46, 47, 381; 60/39.25, 39.47, 431; 137/522, 523

[56] References Cited

U.S. PATENT DOCUMENTS

| | | | |
|---|---|---|---|
| 2,229,805 | 1/1941 | Graves | 60/39.25 |
| 2,298,646 | 10/1942 | Ovens | 137/522 X |
| 2,871,995 | 2/1959 | Cline | 137/522 X |
| 2,922,050 | 1/1960 | Loughran | 60/39.47 X |
| 2,971,097 | 2/1961 | Corbett | 60/39.47 |
| 3,031,842 | 5/1962 | Ledwith | 60/39.47 |
| 3,035,408 | 5/1962 | Silver | 417/47 X |
| 3,046,897 | 7/1962 | Badenoch | 60/39.47 X |
| 3,067,683 | 12/1962 | Wolf | 60/39.47 |
| 3,075,542 | 1/1963 | Diesing | 60/39.25 X |
| 3,078,668 | 2/1963 | Burriss | 60/39.25 |
| 3,085,512 | 4/1963 | Alyanak et al. | 60/39.47 X |
| 3,150,814 | 9/1964 | Evans et al. | 417/47 X |
| 3,180,088 | 4/1965 | Swain | 60/39.25 |
| 3,266,251 | 8/1966 | Kacek | 60/39.47 |
| 3,304,722 | 2/1967 | Culpepper | 60/253 |
| 3,332,237 | 7/1967 | LoFiego | 60/39.47 |
| 3,916,946 | 11/1975 | Motzer | 137/522 X |
| 4,276,960 | 7/1981 | Webb et al. | 137/529 X |

*Primary Examiner*—Carlton R. Croyle
*Assistant Examiner*—Paul F. Neils
*Attorney, Agent, or Firm*—Wood, Dalton, Phillips, Mason & Rowe

[57] ABSTRACT

A hydraulic power supply system utilizing a turbine-driven pump in a hydraulic circuit and a solid propellant gas generator providing gas for driving the turbine. A gas pressure relief valve is operable to maintain the gas generator at constant pressure and has a range of pressure settings to vary the burn rate of gas generator and, thus, the power delivered to the turbine dependent upon the flow demands on the pump. There is a relatively low pressure setting when there is a reduced flow demand on the pump. The control provided by the settable hot gas relief valve reduces the size and weight of a number of components of the hydraulic supply system.

12 Claims, 2 Drawing Figures

HYDRAULIC POWER SUPPLY SYSTEM UTILIZING A SOLID PROPELLANT GAS GENERATOR

DESCRIPTION

1. Technical Field

This invention relates to a hydraulic power supply system utilizing a solid propellant gas generator with improved control of the burn rate of the solid propellant which is related to the hydraulic flow demand to reduce the weight of components of the system.

2. Background Art

In flight control of aircraft and, particularly, rocket-powered missiles, a hydraulic power supply system is often used to supply hydraulic power for components, such as steering actuators. The hydraulic power supply system has a hydraulic circuit with a pump driven by a gas-driven turbine which is supplied with hot gas from a solid propellant gas generator which is ignited when the missile is launched and continues to burn throughout the period when hydraulic power is required.

The burn rate of the solid propellant in the solid propellant gas generator is a function of temperature and pressure in the chamber of the gas generator as well as the composition of the propellant.

The solid propellant burn rate is sensitive to initial propellant temperature, burning faster if the propellant is warm, and slower if the propellant is cold. The burn rate is also sensitive to the gas pressure developed in the chamber of the gas generator as the propellant burns. High pressures in the chamber increase the burn rate. The rate at which the solid propellant burns determines the pressure of the hot gas delivered to the turbine and the pressure in the gas generator. In order to avoid compounding the effect of temperature and pressure sensitivity, a pressure relief valve is frequently used with the gas generator to maintain the gas generator at constant pressure and, thus, provide essentially constant gas horsepower to drive the gas-driven turbine.

The Kacek U.S. Pat. No. 3,266,251, owned by the assignee of this application, discloses a solid propellant gas generator for driving a gas-driven turbine.

The Kacek patent discusses the variableness of the burn rates, depending upon temperature and pressure conditions and discloses a burn rate control valve associated with the gas generator for controlling burn rate by varying the pressure in the gas generator.

In a hydraulic power supply system for a rocket-powered missile, the hydraulic demand is not constant and typically consists of a short period of high fluid flow when operation begins, followed by a long period of much lower flow demand. In order to prevent overspeed of the gas-driven turbine and pump during the periods of low flow demand, a hydraulic relief valve has been in the hydraulic circuit to maintain loading on the pump. This relief valve flow, during low flow demand, is dissipated as heat which requires increasing the size of the oil reservoir which supplies oil to the hydraulic circuit to provide an additional heat sink. The heat sink requirements are quite high on typical hydraulic power supply systems for rocket-powered missiles so that there is a weight penalty in such system because of the required size of the reservoir and the amount of oil used.

The invention to be described hereinafter distinguishes over the prior art in providing means for controlling the gas power provided by the solid propellant gas generator and reducing this gas power delivered to the gas-driven turbine during periods of low flow demand in the hydraulic circuit. This avoids the requirement for relief valve flow during low flow demand operation. This reduces the weight of the reservoir and oil providing the oil heat sink. Also, there is a reduced burn rate of solid propellant during periods of low flow demand and, as a result, there is a lowered requirement for weight of solid propellant and, therefore, a further weight reduction.

DISCLOSURE OF INVENTION

The invention relates to a hydraulic power supply system utilizing a gas-driven turbine driving a pump in a hydraulic circuit and a solid propellant gas generator providing gas for driving the gas-driven turbine, with means for varying the pressure in the gas generator and, therefore, the burn rate of the solid propellant to provide gas power to the gas-driven turbine dependent upon the flow demand on the pump. The system includes a gas pressure relief valve which functions to maintain the gas generator at constant pressure and which has a valve member urged to a closed position by a first spring establishing a first pressure setting for the gas pressure relief valve, with preload means for increasing the pressure setting of the gas pressure relief valve including means acting on said first spring to provide a preload force thereon. A hydraulic piston is connected to said preload means acting on the spring and which is subject to pressure acting in a direction to reduce the force of said preload means. A pressure is applied to the hydraulic piston inversely proportional to flow demand on the pump. A high flow demand on the pump will not cause the hydraulic piston to operate. A range of low flow demands on the pump will cause the hydraulic piston to proportionally reduce the force of the preload means.

A primary feature of the invention is to provide a hydraulic power supply system utilizing a solid propellant gas generator providing gas for driving a gas turbine associated with a pump in a hydraulic circuit and having means for varying the setting of a gas pressure relief valve to vary the burn rate of the gas generator dependent upon the flow demand on the pump.

Another feature of the invention is to provide a hydraulic power supply system having a solid propellant gas generator providing a pressurized gas for driving a turbine which powers a hydraulic pump, characterized by a gas relief valve settable at several different pressures for controlling the pressure of the gas delivered to the turbine, and means for varying the setting of the relief valve dependent upon the hydraulic demand on the hydraulic pump.

An object of the invention is to provide a hydraulic power supply system for a rocket-powered missile or the like wherein a hot gas relief valve used to maintain the solid propellant gas generator at constant pressure is modified and improved in order to reduce the burn rate of the solid propellant and, therefore, the gas power provided by the gas generator when there is little or no requirement for hydraulic power in the system.

Another object of the invention is to provide a hydraulic power system utilizing a turbine-driven pump in a hydraulic circuit and a solid propellant gas generator providing gas for driving the turbine with a gas pressure relief valve operable to maintain the gas generator at constant pressure, characterized by means for varying the relief setting of the gas pressure relief valve to vary the burn rate of the gas generator dependent upon the requirements imposed on the pump.

Still another object of the invention is to provide a hydraulic power supply system for a rocket-powered missile or the like comprising, a hydraulic circuit having a reservoir and a pump for pumping fluid from the reservoir, a gas-driven turbine for driving the pump, a solid propellant gas generator having a gas outlet with a connection to the gas-driven turbine, a gas pressure relief valve in said connection and having a valve member, a spring acting on said valve member urging the valve member to a closed position against a valve seat, preload means acting on said spring to increase the pressure setting at which the gas pressure relief valve will open, and means for controlling the action of the preload means dependent on the flow demand on the pump.

Still another object of the invention is to provide a hydraulic power system utilizing a gas turbine-driven pump in a hydraulic circuit and a solid propellant gas generator providing gas for driving the turbine and a gas pressure relief valve associated with the gas generator for maintaining the gas generator at constant pressure including a valve member urged to a closed position by a first spring establishing a first pressure setting, preload means for increasing the pressure of the gas pressure relief valve including a spring seat member engaging said first spring and a second spring acting on said spring seat member in a direction to provide a preload force on the first spring, a hydraulic piston connected to the spring seat member and movably mounted in a cylinder having a fluid connection whereby fluid pressure may act on said hydraulic piston in a direction to oppose the force of said second spring, means for directing a fluid pressure to said cylinder inversely proportional to flow demand on the pump, and the area of the hydraulic piston and the force exerted by the second spring are related whereby a range of low flow demands on the pump will cause the hydraulic piston to move the spring seat member against the action of the second spring to reduce the preload on the first spring and a high flow demand on the pump will not move the hydraulic piston. The pressure in the gas generator and, therefore, the burn rate of the solid propellant are controlled in accordance with the hydraulic flow demand.

Still another object of the invention is to have a hydraulic power supply system as defined in the preceding paragraphs wherein the pump is of the type that has a pressure drop upon increased flow demand and, thus, the hydraulic piston as recited in the preceding paragraph can be directly exposed to pressure in the hydraulic circuit downstream of the pump for control of the setting of the gas pressure relief valve.

BEST MODE FOR CARRYING OUT THE INVENTION

Figure 1:
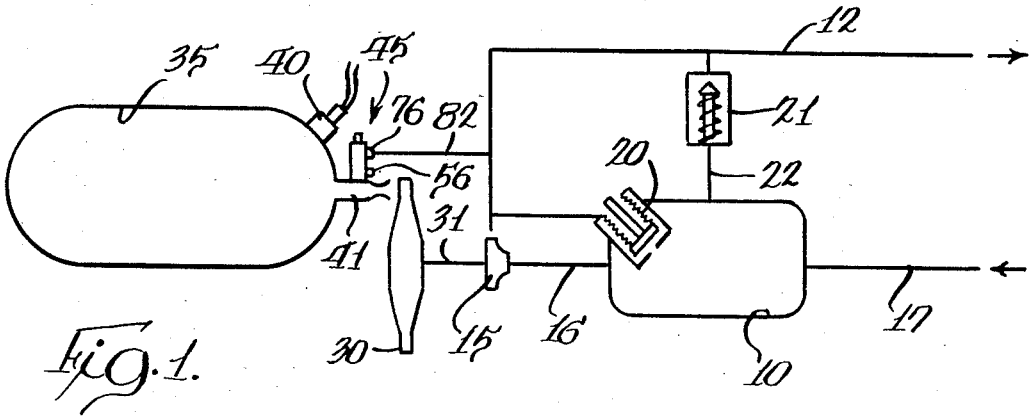
FIG. 1 is a schematic illustration of the hydraulic power supply system.

The hydraulic power supply system is shown generally in FIG. 1 and has a hydraulic circuit including a reservoir 10 for oil with a pressure line 12 of the hydraulic circuit being supplied with fluid under pressure by a pump 15 having its outlet connected to the pressure line 12. A line 16 connects the inlet of the pump with the reservoir and a line 17 of the hydraulic circuit connects with the reservoir for return of oil thereto.

The reservoir 10 may have an accumulator associated therewith, as shown at 20, and the pressure line 12 of the hydraulic circuit has a relief valve 21 in line 22 communicating therewith whereby a predetermined pressure, dependent upon the setting of the relief valve 21, cannot be exceeded in the pressure line 12. The hydraulic circuit has valving and one or more hydraulic motors therein (not shown) which can be used for movement of mechanism, such as steering actuators of a rocket-powered missile.

The pump 15 is driven by a gas-driven turbine 30 through a connecting drive shaft 31, with gas power for driving the gas-driven turbine 30 being supplied by a solid propellant gas generator 35. The gas generator contains a solid propellant having a burn rate which is a function of temperature and pressure in the combustion chamber of the gas generator 35. The burn rate of the propellant increases with increase in temperature and pressure in the combustion chamber and the gas pressure increases with an increase in the burn rate.

The solid propellant in the gas generator 35 is ignited by an electrically-operated igniter 40 and burning of the solid propellant generates the hot gas at a pressure which flows from a gas generator outlet to a gas passage 41 leading to the inlet of the gas-driven turbine 30.

A hot gas relief valve, indicated generally at 45, communicates with the gas passage 41 and operates to maintain the gas generator at a constant pressure. The hot gas relief valve is particularly shown in FIG. 2. The hot gas relief valve 45 has a range of pressure settings whereby different pressures can exist in the solid propellant gas generator to provide different burn rates and, thus, different rates of gas power supply to the gas-driven turbine 30.

Figure 2:
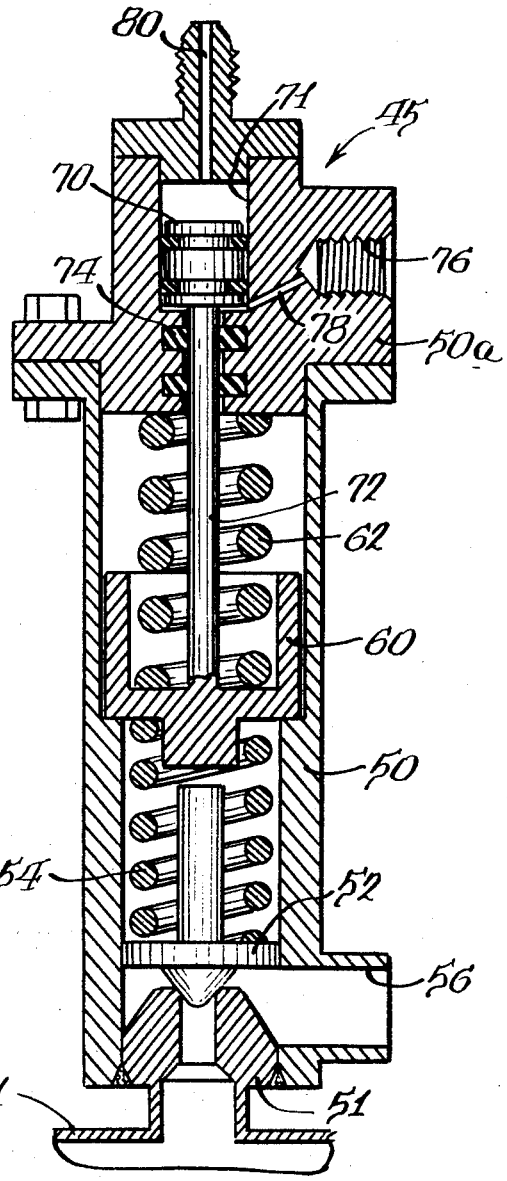
FIG. 2 is a central vertical section of one embodiment of a hot gas relief valve usable in the invention.

As seen in FIG. 2, the hot gas relief valve has a body 50, with a valve seat 51 at an inlet communicating with the gas passage 41 between the gas generator and the gas-driven turbine. A valve member 52, in the form of a poppet, coacts with the valve seat 51 and is urged to a closed position on the valve seat by a first spring 54. When the relief valve opens by movement of the valve member 52 off the valve seat 51, gas can flow from the gas passage 41 to an exhaust port 56 with resultant reduction of pressure in the gas generator.

Preload means are associated with the first spring 54 to increase the pressure setting of the hot gas relief valve. This preload means includes a cup-shaped spring seat member 60 movably mounted within the bore of the valve body 50 and engageable with an end of the first spring 54. A second spring 62 engages between a valve body part **50*a* and the spring seat member 60 to exert a preload force on the first spring 54. With the structure of the hot gas relief valve positioned as shown in FIG. 2, the hot gas must be at a relatively high pressure to unseat the valve member and permit exhaust of gas through the exhaust port 56**.

The preload force on the first spring 54 can be reduced by raising the spring seat member 60, as viewed in FIG. 2. The means for accomplishing this comprises a hydraulic piston 70 movable within a cylinder 71 formed within the valve body part **50*a*. The hydraulic piston 70 is connected to the spring seat member 60 by a rod 72 and surrounding seals 74 seal the cylinder from the bore of the valve body. The valve body part 50*a* has a port 76 communicating with a passage 78 leading to an end of the cylinder 71 whereby hydraulic pressure can be applied to the exposed area of the underside of the piston 70 surrounding the rod 72. A bleed port 80 extends from an end of the cylinder 71**.

As seen in FIG. 1, the port 76 communicates with a fluid line 82 connected into the pressure line 12 of the hydraulic circuit downstream of the pump 15.

In the embodiment of the invention disclosed, the pump 15 is of the type that has a drop in output pressure upon increased flow demand in the hydraulic circuit, with one such type of pump being a centrifugal pump. Thus, the underside of the hydraulic piston 70 is exposed to a pressure which is inversely proportional to flow demand upon the pump 15.

In the use of the hydraulic power supply system to provide hydraulic power for rocket-powered missile components, there are varying flow demands, with there being an initial high flow demand upon initial operation and followed by a relatively long period of little or no flow demand. When controlling steering actuators of the rocket-powered missile, there is considerable activity in initially stabilizing the actuators and, thereafter, this activity reduces with a reduced flow demand on the hydraulic power supply system. When there is a high flow demand on the pump, there is a relatively low hydraulic pressure in the pressure line 12 of the hydraulic circuit. This hydraulic pressure applied to the underside of the hydraulic piston 70 is not sufficient to overcome the force of the second spring 62 and, thus, the preload means exerts a preload force on the first spring 54 and the hot gas relief valve functions to maintain a relatively high constant gas pressure for a relatively high burn rate and gas power supply to the gas-driven turbine 30.

When there is reduced flow demand, the pressure in the hydraulic circuit increases and, when the pressure acting on the lower side of the piston 70 creates a force sufficient to overcome the force of the second spring 62, the spring seat member 60 is raised from the position shown in FIG. 2 to reduce the preload on the first spring 54 and the hot gas relief valve functions to maintain a lower gas pressure with a resulting lower burn rate in the gas generator and lesser delivery of gas power to the pump 15. This inherently reduces the tendency of the gas-driven turbine and pump to overspeed during periods of low system demand.

The area of the piston 70 exposed to pressure and the preload of the second spring 62 are selected to permit the hot gas relief valve to begin actuation at the hydraulic system design pressure.

From the foregoing, it will be evident that the control function imparted to the hot gas relief valve from the different pressure settings thereof provides that the relief valve is always operable to maintain constant gas pressure at the desired setting of the hot gas relief valve and accommodate variations in burn rate due to temperature or manufacturing tolerances. The hot gas relief valve is also operative during the start interval to protect the hot gas components from pressure excursions during the start transient resulting from the igniter charge which can cause an overpressure spike.

The invention has been disclosed with the hydraulic signal to the hot gas pressure relief valve being derived directly from the pressure existing in the pressure line 12 of the hydraulic circuit. It would also be possible to generate the hydraulic signal in response to hydraulic flow in the hydraulic circuit or in response to a speed signal, such as measured by flow through a fixed displacement pump.

I claim:

1. A hydraulic power supply system utilizing a turbine-driven pump in a hydraulic circuit and a solid propellant gas generator providing gas for driving the turbine with a gas pressure relief value operable to maintain the gas generator at constant pressure characterized by means for varying the relief setting of the gas pressure relief valve to control the burn rate of the gas generator by controlling the gas generator pressure dependent upon the requirements imposed on the pump.

2. A hydraulic power supply system as defined in claim 1 wherein said means for varying the relief setting is responsive to pressure in said hydraulic circuit.

3. A hydraulic power supply system as defined in claim 1 wherein an increase in pressure in said hydraulic circuit reduces the relief setting.

4. A hydraulic power supply system having a solid propellant gas generator providing a pressurized gas for driving a turbine which powers a hydraulic pump, characterized by a gas relief valve settable at several different pressures to control the burn rate by controlling the pressure of the gas delivered to the turbine, and means for varying the setting of the relief valve dependent upon the hydraulic demand on the hydraulic pump.

5. A hydraulic power supply system as defined in claim 4 wherein said relief valve has a preloaded spring, and said means for varying the setting of the relief valve includes a movable member operable to reduce the preload on the spring, and means for moving said member to reduce said preload when there is relatively low demand on the hydraulic pump.

6. A hydraulic power supply system comprising, a hydraulic circuit having a reservoir and a pump for pumping fluid from the reservoir, a gas-driven turbine for driving the pump, a solid propellant gas generator having a gas outlet with a connection to the gas-driven turbine, a gas pressure relief valve in said connection for controlling the burn rate of the gas generator by controlling the gas generator pressure, said relief valve having a valve member, a spring acting on said valve member urging the valve member to a closed position against a valve seat, preload means applying a force to said spring to increase the pressure setting at which the gas pressure relief valve will open, and means for raising and lowering the force applied by the preload means dependent on the flow demand on the pump during operation of the hydraulic power supply system.

7. A hyraulic power supply system as defined in claim 6 wherein said preload means includes a spring seat member engaging said spring, and a second spring urging said spring seat member toward said spring, and said means for raising and lowering the force applied by the preload means includes a hyraulic piston connected to said spring seat member and a fluid connection between the hydraulic circuit downstream of the pump and said hydraulic piston.

8. A hydraulic power supply system as defined in claim 6 wherein the means for raising and lowering the force applied by the preload means includes a member responsive to the output pressure of the pump.

9. A hydraulic power supply system as defined in claim 8 wherein said pump is of the type that has a drop in output pressure in response to an increased flow demand in the hydraulic circuit.

10. A hydraulic power supply system comprising, a pump for supplying fluid to a hydraulic circuit, a gas-driven turbine for driving the pump, a solid propellant gas generator for supplying gas under pressure to said gas-driven turbine, a gas pressure relief valve operatively connected to said solid propellant gas generator to maintain the latter at constant pressure including a valve member urged to a closed position on a valve seat by a first spring establishing a first pressure setting, preload means for increasing the pressure setting of the gas pressure relief valve including means acting on said first spring to provide a preload force thereon, a hydraulic piston connected to said means acting on the first spring and subject to fluid pressure acting in a direction to reduce the force of said preload means, means for directing a fluid pressure to said hydraulic piston inversely proportional to flow demand on the pump whereby a low flow demand on the pump will cause the hydraulic piston to reduce the force of the preload means and a high flow demand on the pump will not have any effect on the preload means.

11. A hydraulic power supply system comprising, a pump for supplying fluid to a hydraulic circuit, a gas-driven turbine for driving the pump, a solid propellant gas generator, means defining a gas passage between an outlet of said solid propellant gas generator and an inlet of said gas-driven turbine, a gas pressure relief valve connected to said gas passage for maintaining the gas generator at constant pressure including a valve member urged to a closed position on a valve seat by a first spring establishing a first pressure setting, preload means for increasing the pressure setting of the gas pressure relief valve including a spring seat member engaging said first spring and a second spring acting on said spring seat member in a direction to provide a preload force on said first spring, a hydraulic piston connected to said spring seat member and movably mounted in a cylinder, a fluid connection to said cylinder whereby fluid pressure acts on said hydraulic piston in a direction to oppose the force of said second spring, means for directing a fluid pressure to said cylinder inversely proportional to flow demand on the pump, and the area of the hydraulic piston and the force exerted by the second spring are related whereby a range of low flow demands on the pump will cause the hydraulic piston to move the spring seat member against the action of the second spring to reduce the preload on the first spring and a high flow demand on the pump will not result in movement of the hydraulic piston.

12. A hydraulic power supply system as defined in claim 11 wherein said pump is of the type which has a drop in output pressure upon increased flow demand in the hydraulic circuit and said cylinder fluid connection connects into said hydraulic circuit downstream of the pump.

* * * * *